US006585569B2

(12) United States Patent
Tomlinson

(10) Patent No.: US 6,585,569 B2
(45) Date of Patent: Jul. 1, 2003

(54) METHOD OF CLEANING GAS TURBINE COMPRESSORS USING CRUSHED, SOLID MATERIAL CAPABLE OF SUBLIMATING

(75) Inventor: James Andrew Tomlinson, Albany, NY (US)

(73) Assignee: General Electric Company, Schenectady, NY (US)

( * ) Notice: Subject to any disclaimer, the term of this patent is extended or adjusted under 35 U.S.C. 154(b) by 113 days.

(21) Appl. No.: 09/749,447

(22) Filed: Dec. 28, 2000

(65) Prior Publication Data

US 2002/0086616 A1 Jul. 4, 2002

(51) Int. Cl.[7] ..... B34B 1/10

(52) U.S. Cl. ..... 451/39; 451/38; 451/40; 451/51; 451/53; 134/22.18

(58) Field of Search ..... 451/38, 39, 40, 451/51, 53; 134/22.18

(56) References Cited

U.S. PATENT DOCUMENTS

| | | | | | |
|---|---|---|---|---|---|
| 4,051,636 | A | * | 10/1977 | Heine | 409/110 |
| 4,808,235 | A | * | 2/1989 | Woodson et al. | 134/22.19 |
| 5,076,855 | A | * | 12/1991 | Kaes | 134/19 |
| 5,632,150 | A | * | 5/1997 | Henzler | 451/39 |
| 5,885,133 | A | * | 3/1999 | Williams, Jr. | 451/28 |
| 6,174,225 | B1 | * | 1/2001 | Becker | 451/39 |
| 6,310,022 | B1 | * | 10/2001 | Amiran | 134/2 |
| 6,311,704 | B1 | * | 11/2001 | Foster | 134/166 R |

* cited by examiner

*Primary Examiner*—Lee D. Wilson
*Assistant Examiner*—Alvin J. Grant
(74) *Attorney, Agent, or Firm*—Banner & Witcoff, Ltd.

(57) ABSTRACT

A method of cleaning gas turbine compressors using crushed, solid, sublimable material, such as dry ice, which can be used in during low temperature conditions, poses no risk of ice formation, clogging cooling hole passages, or degrading the emissions from the turbine.

14 Claims, 1 Drawing Sheet

METHOD OF CLEANING GAS TURBINE COMPRESSORS USING CRUSHED, SOLID MATERIAL CAPABLE OF SUBLIMATING

FIELD OF THE INVENTION

The present invention relates to a method of cleaning the inner surfaces of gas turbine that accumulate deposits, which can negatively affect the performance of the turbine. More particularly, the present invention relates to a method of cleaning gas turbine compressors using crushed, solid material that undergoes sublimation, such as dry ice, which can be used in cold weather conditions, poses no risk of ice formation, clogging of cooling hole passages, or degrading the emissions from the turbine.

BACKGROUND OF THE INVENTION

As gas turbine compressors operate, deposits accumulate on the inner surfaces of the compressor. Such deposits, known as fouling, can reduce the operating efficiency and output power, and result in an increase in fuel consumption. As a consequence the compressors must be cleaned continuously or repeatedly.

Traditionally, solid particles, such as rice or ground nutshells have been used to clean deposits from the inner surfaces of gas turbine compressors. However, the use of such solid materials has numerous drawbacks. First, such particles are accelerated into the interior of the compressor by high-pressure air. As a result, the particles can cause damage to the inner surfaces and the internal compressor parts. Second, such solid particle abrasives can clog cooling passages. Third, any particulate matter remaining in the compressor after cleaning may become ash when burned in the combustors resulting in potentially harmful emissions. Fourth, spent abrasive material needs to be disposed of after cleaning. However, if the abrasive solid particle material is an environmental hazard, it may be difficult to dispose of.

To overcome some of the foregoing drawbacks of solid particle compressor cleaning, water, has been used as a cleaning agent that is pumped into the compressors. However, such water washing has its own inherent drawbacks discussed below.

Referring to FIG. 1, a traditional water washing system is illustrated. The turbine 10 has a bellmouth 12 that faces the inlet plenum 14. Water is supplied through supply lines 18 to pumps 24 and 20. Pump 20 is connected to an on-line manifold having nozzles 16 positioned just above or upstream of the bellmouth 12. Similarly, the pump 24 is connected to an off-line manifold having nozzles 22 positioned just above or upstream of the bellmouth 12.

Water cleaning agents can be used while the turbine is not in operation, known as off-line cleaning, or while the compressor is running, known as on-line cleaning. Off-line cleaning has an advantage in that it is more effective at removing the deposits. On the other hand, while off-line the compressor is not generating power, at a significant loss to the operator. Although on-line cleaning can be performed while the compressor is running, usually at a reduced level of performance, it is less effective at removing the accumulated deposits.

Water is not as effective as solid particles in cleaning the deposits from the inner surfaces of the compressor. Furthermore, water can be used only when certain environmental conditions are met. In particular, when ambient temperatures are below 50° Fahrenheit, in this environment there is a strong likelihood that the water will freeze, thereby creating ice formations that can damage the compressor, such as inlet guide vanes (IGVs). These ice formations can result in severe damage to parts such as the IGVs, which are expensive to manufacture and replace. As is the case with traditional solid particle cleaning, water may present an environmental hazard that presents disposal problems.

In an attempt to increase the temperature range within which water can be used, additives have been mixed with the water to lower its freezing point. However, such additives produce emissions that do not comply with local and federal codes and requirements concerning the handling of hazardous materials and environmental regulations.

BRIEF SUMMARY OF THE INVENTION

The foregoing and other deficiencies of the conventional technique are addressed by the method of cleaning gas turbine compressors according to the present invention. An exemplary method of cleaning gas turbine compressors uses crushed, solid material that undergoes sublimation. In one aspect of the invention the solid material is dry ice, which can be used in cold weather conditions. Dry ice poses no risk of ice formation, clogging of cooling hole passages, or degrading the emissions from the turbine.

BRIEF DESCRIPTION OF THE DRAWINGS

The structure, operation and advantages of the presently preferred embodiment of this invention will become apparent upon consideration of the following description, taken in conjunction with the accompanying drawing in which.

DETAILED DESCRIPTION OF THE INVENTION

Figure 1:
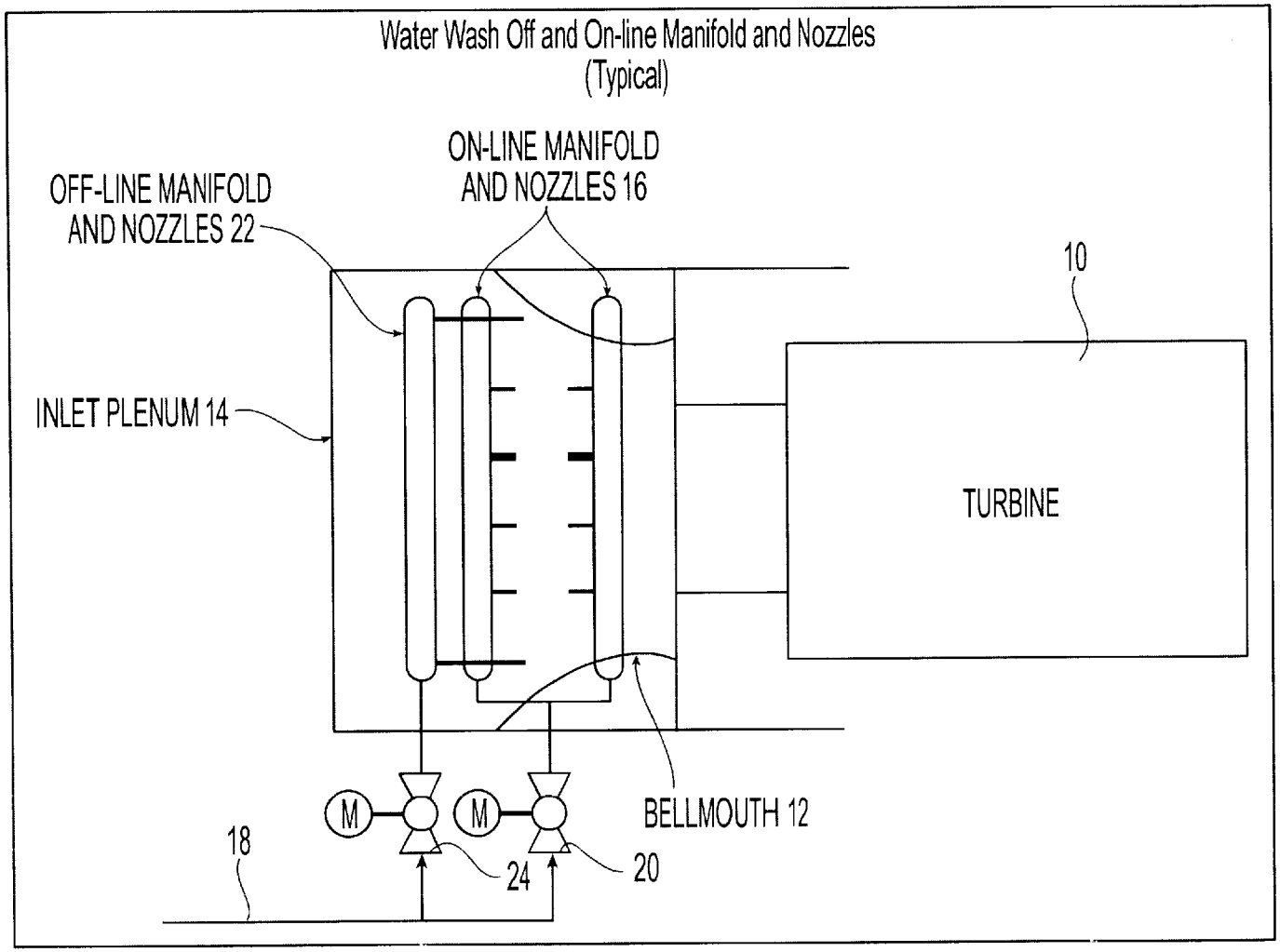
FIG. 1 is a schematic block diagram of a conventional turbine compressor having an on-line and off-line water wash cleaning system.

The method of present invention benefits from the more effective deposit removal advantage of solid particle cleaning, while eliminating the risk of clogging cooling passages or disposing of spent particles. Furthermore, the present method can be used in the traditional water washing system shown in FIG. 1.

The present method employs materials that sublimate, i.e., undergo a direct phase change from solid phase to gaseous phase without entering the liquid phase. In an exemplary embodiment, dry ice, a solid form of carbon dioxide, ($CO_2$) can be used. The dry ice particles can be used at temperatures below 50° Fahrenheit. Dry ice particles are injected into the turbine 10 through either the nozzles 16 or nozzles 22, depending on whether on-line or off-line cleaning is being performed.

In an exemplary embodiment of the method of the present invention, on-line cleaning with crushed sublimable material is performed with the turbine 10 operating at a base load with the IGVs at a full open position. The sublimable material is injected into the turbine 10 just above or up-stream of the bellmouth 12.

The sublimable material may self-inject due to the differential pressure between the atmosphere and the inlet air pressure. Self-injection, or pump-less injection, occurs when a lower pressure is developed inside the turbine compressor than the pressure outside the turbine compressor. In such a situation, the injection rate of the solid material can be controlled by adjusting the size of the injection port. Alternatively, the pumps 20 and 24 may be used to inject the sublimable material.

The preferred material is dry ice, which has inherent advantages over water, rice or crushed nutshells. Dry ice has a freezing point of −100° Fahrenheit, and therefore can be used at low ambient temperatures, e.g., below 50° Fahrenheit, without causing ice formation on any of the compressor components, such as the IGVs. Furthermore, dry ice will not clog cooling passages as the carbon dioxide particles should sublime to a gas during the cleaning operation. In addition, dry ice will not affect the combustion process of the turbine or the combustion byproducts of the turbine, since carbon dioxide is one of the normal resulting byproducts of combustion. Since carbon dioxide is a semi-organic compound, it can attract some of the organic compounds that form the deposits on the interior of the compressor, thereby providing a higher degree of cleaning than water, rice or crushed nutshells. The sublimation of the cleaning material means there is no spent material requiring disposal.

In a preferred embodiment, the dry ice particles can be a mix of 00 (double ought) sand size to ¼ inch diameter, with an approximately equal percentage of sizes of particles. The larger particles should last longer during the cleaning process than the smaller particles before sublimating. Alternatively, a single size of particles may be employed. The variety and percentage of sizes of particles employed can be tailored to the compressor configuration, the degree of deposit buildup, and/or ambient conditions.

Having described several embodiments of the method of cleaning a turbine compressor, according to the present invention, it is believed that other modifications, variations and changes will be suggested to those skilled in the art in view of the description set forth above, such as employing other materials that sublimate in the same temperature range as dry ice. It is therefore to be understood that all such variations, modifications and changes are believed to fall within the scope of the invention as defined in the appended claims.

What is claimed is:

1. A method of cleaning a turbine compressor, comprising:

providing at least one particle size of solid particles, said solid particles being capable of sublimation;

injecting said solid particles into said turbine compressor through a port in said turbine compressor; and operating said gas turbine at a base load while performing said injecting.

2. A method of cleaning a turbine compressor, as recited in claim 1, comprising maintaining internal guide vanes at a full open position prior to said injecting.

3. A method of cleaning a turbine compressor, comprising providing at least one particle size of solid particles, said solid particles being capable of sublimation; and injecting said solid particles into said turbine compressor through a port in said turbine compressor, wherein said solid particles are injected just up stream of a bellmouth of said turbine compressor.

4. A method of cleaning a turbine compressor, comprising providing at least one particle size of solid particles, said solid particles being capable of sublimation; and injecting said solid particles into said turbine compressor through a port in said turbine compressor, wherein said injecting further comprises developing a lower pressure inside said turbine compressor.

5. A method of cleaning a turbine compressor, as recited in claim 4 further comprising setting a rate of injection of said solid particles by adjusting a size of said port.

6. A method of cleaning a turbine compressor, comprising:

providing at least one particle size of solid dry ice particles, which are capable of sublimation;

injecting said solid particles into said turbine compressor; and operating said gas turbine at a base load, while performing said injecting step.

7. A method of cleaning a turbine compressor, as recited in claim 6, wherein said solid particles are dry ice.

8. A method of cleaning a turbine compressor, as recited in claim 6, wherein said solid particles are injected just up stream of a bellmouth of said turbine compressor.

9. A method of cleaning a turbine compressor, as recited in claim 6, wherein said injecting further comprises developing a lower pressure inside said turbine compressor than pressure outside said turbine compressor.

10. A method of cleaning a turbine compressor, as recited in claim 6, further comprising setting a rate of injection of said solid particles by adjusting a size of an injection port in said turbine compressor.

11. A method of cleaning a turbine compressor, as recited in claim 6, wherein said providing comprises providing multiple sizes of said solid particles.

12. A method of cleaning a turbine compressor, as recited in claim 6, wherein said injecting is performed at ambient temperatures below 50° Fahrenheit.

13. A method of cleaning a turbine compressor, as recited in claim 11, wherein said multiple sizes of said solid particles have a diameter in a range of 00 to ¼ inch.

14. A method as recited in claim 10, further comprising opening internal guide vanes full open position prior to said injecting.

* * * * *

UNITED STATES PATENT AND TRADEMARK OFFICE

CERTIFICATE OF CORRECTION

PATENT NO. : 6,585,569 B2
DATED : July 1, 2003
INVENTOR(S) : James Andrew Tomlinson It is certified that error appears in the above-identified patent and that said Letters Patent is hereby corrected as shown below:

Column 1,
Line 53, -- or solid particle -- has been inserted before "cleaning agents";
Line 53, "turbine" has been replaced with -- compressor --;

Column 2,
Line 3, "inlet" has been replaced with -- internal --;

Column 4,
Line 15, -- than pressure outside said turbine compressor -- has been inserted after "said turbine compressor";
Line 17, -- , -- has been inserted after "4";
Line 51, -- to a -- has been inserted before "full open position".

Signed and Sealed this

Twenty-eighth Day of October, 2003

JAMES E. ROGAN
*Director of the United States Patent and Trademark Office*